US006047948A

United States Patent [19]

Hasegawa et al.

[11] Patent Number: 6,047,948

[45] Date of Patent: Apr. 11, 2000

[54] FUEL INJECTION NOZZLE

[75] Inventors: Toshiyuki Hasegawa; Takeshi Miyamoto; Shinya Nozaki, all of Higashimatsuyama, Japan

[73] Assignee: Zexel Corporation, Tokyo, Japan

[21] Appl. No.: 08/793,364

[22] PCT Filed: Aug. 31, 1995

[86] PCT No.: PCT/JP95/01730

§ 371 Date: Feb. 24, 1997

§ 102(e) Date: Feb. 24, 1997

[87] PCT Pub. No.: WO96/09472

PCT Pub. Date: Mar. 28, 1996

[30] Foreign Application Priority Data

Sep. 22, 1994 [JP] Japan ..... H6-254539

[51] Int. Cl.[7] ..... F02M 51/06

[52] U.S. Cl. ..... 251/129.18; 251/285; 239/533.4; 239/581.1

[58] Field of Search ..... 251/129.18, 285; 123/446, 467, 305, 504; 239/533.4, 585.4, 581.1, 451, 574

[56] References Cited

U.S. PATENT DOCUMENTS 4,327,695 5/1982 Schechter ..... 123/504
4,501,245 2/1985 Taira ..... 123/504
4,637,553 1/1987 Kushida et al. ..... 239/533.4
4,658,824 4/1987 Scheibe ..... 239/533.4
5,004,154 4/1991 Yoshida et al. ..... 239/533.4
5,048,489 9/1991 Fischer et al. ..... 123/467
5,199,641 4/1993 Hohm et al. ..... 251/129.18
5,312,050 5/1994 Schumann et al. ..... 251/129.18
5,381,999 1/1995 Ricco ..... 251/129.18
5,645,225 7/1997 Hasegawa et al. ..... 239/581.1

*Primary Examiner*—Thomas N. Moulis
*Attorney, Agent, or Firm*—Wenderoth, Lind & Ponack L.L.P.

[57] ABSTRACT

The fuel injection nozzle according to the present invention comprises a nozzle body provided with nozzle holes, a needle valve that opens and closes the nozzle holes, an armature that is mechanically linked with the needle valve and a stator that faces opposite the armature, so that, by displacing the stator with a micromotor, the lift quantity of the needle valve can be adjusted. In addition, a cover member that rotates slidably around the circumference of the nozzle body is provided and by causing this cover member to rotate with a micromotor, the opening area of the nozzle hole contributing to injection is varied. With these structural features, it becomes possible to intentionally achieve a desired injection pattern.

19 Claims, 11 Drawing Sheets

FUEL INJECTION NOZZLE

FIELD OF THE INVENTION

The present invention relates to a fuel injection nozzle that supplies fuel to an internal combustion engine such as a diesel engine. In particular, it relates to a fuel injection nozzle capable of achieving various spraying patterns by changing the lift quantity of the needle valve and the total opening area of the nozzle hole contributing to injection.

DESCRIPTION OF THE RELATED ART

Fuel injection nozzles employed in internal combustion engines include, for instance, the one disclosed in Japanese Unexamined Patent Publication No. S59-200063, which injects fuel through a nozzle hole formed at the front end portion of a nozzle body, with a pressure receiving surface formed in a tapered shape provided at a needle valve housed slidably inside the nozzle body and the needle valve made to open by applying fuel pressure to the pressure receiving surface.

In addition, more recent examples include the fuel injection nozzle disclosed in Japanese Unexamined Patent Publication No. H4-76266, which features a technology through which promotion of combustion, improved power and fuel efficiency, reduced combustion noise and reduced NOx discharge are achieved by forming a passage for inducing pressurized fuel to the front end portion of a nozzle body 1, forming a plurality of nozzle holes 2 that communicate with this passage, inserting a rotary valve (rotating shaft) 17 through a needle valve which performs control of intermittent fuel inflow to the passage and varying the rotating position of the rotary valves (rotating shaft) 17 to increase/decrease the opening area of the nozzle holes contributing to fuel spray so that the injection pressure, the injection period and the injection quantity can be varied.

However, in the first fuel injection nozzle, which employs a structure in which the injection pressure, the injection quantity, the injection period and the like are determined by an injection pump that delivers fuel to the fuel injection nozzle, the number of nozzle holes is fixed and, consequently, it is not structurally possible to increase/decrease the total area of the nozzle holes contributing to injection. This presents a problem in that it is difficult to maintain a good combustion state since the injection pressure will be reduced during low speed rotation of the engine and the injection period will be reduced in a low load state of the engine.

In addition, in the second fuel injection nozzle that employs a system in which the nozzle hole in the nozzle body is blocked off from the inside by the rotating shaft, as shown in FIG. 26, there is actually no change in the nozzle hole opening area at the surface of the nozzle body as the nozzle hole is merely constricted from the inside. Thus, there is a problem in that the sprayed fuel does not readily become finely atomized. Moreover, since, in the system in which the nozzle hole in the nozzle body is blocked from the inside, a plurality of guide grooves 18 are required, as shown in FIG. 1 in Japanese Unexamined Patent Publication No. S4-76266, the suck volume cannot be reduced and, consequently, there is a likelihood of residual runoff of fuel occurring after injection, increasing the discharge quantity of HC. Furthermore, in such a structure, it is necessary to improve the accuracy of axial alignment of the needle valve 3 and the rotating shaft 17.

In addition, in the structures in the prior art, there is another problem in that since the structures do not allow the lift quantity of the needle valve to be changed intentionally, it is not possible to vary the injection state intentionally by adjusting the lift quantity to change the pressure loss and cause the injection quantity to increase or decrease to change the injection pressure and the injection rate or the like.

Reflecting the problems discussed above, an object of the present invention is to provide a fuel injection nozzle that is capable of achieving desired injection patterns by intentionally varying the lift quantity of the needle valve or by varying the total area of the nozzle hole contributing to injection so that, ultimately, an injection pressure, an injection period, an injection quantity and the like that are appropriate to the engine load and the engine rotation rate may be achieved to realize a reduction in NOx, an improvement in fuel efficiency and the like.

Another object of the present invention is to provide a fuel injection nozzle achieved by taking into consideration the need for finely atomizing the injected fuel, preventing an increase in the suck volume, allowing for a less rigorous accuracy of axial alignment of the rotating member that changes the effective area of the nozzle hole and the needle valve.

SUMMARY OF THE INVENTION

Accordingly, the fuel injection nozzle according to the present invention comprises a nozzle body with nozzle holes for injecting pressurized fuel formed at its front end portion, a needle valve that is inserted slidably in the nozzle body to open/close the nozzle holes, a spring that applies a force to the needle valve in the direction in which the nozzle holes are closed off, an armature provided on an extended line of the axis of the needle valve, which can be displaced along with the needle valve, a stator that is provided facing opposite the armature on an extended line of the axis of the needle valve and electromagnetically attracts the armature against the force of the spring when power runs through it, a first micromotor that is driven and controlled by an external signal and a lift quantity changing mechanism that employs the first micromotor to achieve a displacement of the stator on an extended line of the axis of the needle valve to make it possible, ultimately, to vary the maximum lift quantity of the needle valve.

The lift quantity changing mechanism may be constituted by: securing the stator in the direction of the axis of the needle valve in such a manner that it can advance or retreat helically and causing the stator to become displaced in the direction of the axis of the needle valve with a gear that interlocks with teeth formed on the external circumferential surface of the stator and is caused to rotate by the first micromotor; by providing the stator slidably in the direction of the axis of the needle valve and causing the stator to become displaced in the direction of the axis of the needle valve with a cylindrical worm that interlocks with a rack portion formed at a portion of the external circumferential surface of the stator and is caused to rotate by the first micromotor; or by providing an arm portion with a female threaded portion formed extending in the direction of the axis of the stator at a side of the stator and causing the stator to become displaced in the direction of the axis of the needle valve with a male threaded portion which is caused to rotate by the first micromotor made to advance or retreat helically over the female threaded portion of the arm portion.

As a result, since the maximum lift quantity of the needle valve is controlled by the lift quantity changing mechanism, during low load, low speed rotation operation when the engine is being started, for instance, fine atomization of injection is promoted by increasing the lift quantity to raise the injection pressure and lengthen the lift period. In addition, during high load, high speed rotation operation, stable combustion is achieved by reducing the lift quantity to lower the injection pressure and shorten the lift period. Moreover, since the flow path cross sectional area changes by varying the lift quantity to vary the flow path resistance, in an accumulator type fuel injection pump, for instance, it becomes possible to change the injection quantity by varying the lift quantity and, in the case of a jerk type fuel injection pump, it becomes possible to vary the injection pressure and the injection rate through varying the lift quantity.

In addition, the fuel injection nozzle according to the present invention comprises a nozzle body with nozzle holes formed at its front end portion for injecting pressurized fuel, a needle valve that is inserted slidably in the nozzle body to open/close the nozzle holes, a cover member that rotates slidably around the nozzle body with blocking portions that change the degree of blockage of the nozzle holes in proportion to the degree of rotation of the cover member formed as an integrated part thereof, and a second micromotor that is driven and controlled by an external signal. In this fuel injection nozzle, the rotation of the cover member is made possible by the second micromotor so that the opening area of the nozzle holes contributing to injection can be varied.

This structure may be achieved, for instance, by forming a plurality of nozzle holes at specific intervals in the circumferential direction of the nozzle body and varying the number of nozzle holes that are blocked off by the blocking portions through the rotation of the cover member so that, ultimately, the opening area of the nozzle holes contributing to injection is varied, or by forming slit-like nozzle holes ranging over a specific angle of the circumference at the front end portion of the nozzle body instead of forming a plurality of nozzle holes and blocking a portion of these nozzle holes formed in a slit shape with the blocking portions to vary the opening area. In the case of the nozzle holes in the former instance, the structure in which the diameters of the nozzle holes are gradually reduced in the order in which the nozzle holes are blocked off by the blocking portions may be adopted and in the case of the nozzle hole in the latter instance, a wedge-shaped structure may be adopted in which the width of the slit is gradually reduced in the direction in which the injection area is reduced by the blocking portions.

In addition, a plurality of nozzle holes that can communicate with the nozzle holes formed at the front end of the nozzle body may be formed at specific intervals in the circumferential direction at the blocking portions of the cover member so that the number of nozzle holes at the blocking portions which communicate with the nozzle holes at the nozzle body can be changed with the rotation of the cover member to vary the opening area of the nozzle holes contributing to injection. In this instance, too, the plurality of nozzle holes formed in the circumferential direction of the blocking portions may be formed with their diameters gradually reduced in the order in which the communication with the nozzle holes at the nozzle body is cut off.

Consequently, according to the present invention, since the rotating position of the cover member is adjusted by the second micromotor to make it possible to vary the opening area of the nozzle holes contributing to injection, during low load, low speed rotation operation when the engine is starting up, for instance, the injection pressure is increased and the injection period is lengthened by reducing the total area of the nozzle holes contributing to injection with the rotation of the cover member. Thus, promotion of fine atomization of the spray and an increase in the excess air factor in the spray can be expected to reduce NOx.

In addition, since the total area of the nozzle holes contributing to injection can be varied from the outside, a reduction in the suck volume formed inside the nozzle body can be achieved and, at the same time, the axial alignment for the cover member, which changes the effective area of the nozzle holes, and the needle valve inside the nozzle body is not required. Moreover, since the nozzle hole opening area can be varied on the surface of the nozzle body by the cover member, fine atomization of injected fuel can be more readily achieved compared to a nozzle in which the nozzle hole opening area is varied from the inside of the nozzle body.

Furthermore, if the total area of the nozzle holes contributing to injection is increased by causing the cover member to rotate during high load, high speed rotation operation, the injection pressure is lowered and the injection period is shortened. This will ensure that spraying will occur at the flow rate that is required for a high load operation and will be evenly dispersed, achieving stable combustion and high output.

DETAILED DESCRIPTION OF THE PREFERRED EMBODIMENTS

The following is a detailed explanation of the present invention in reference to the attached drawings.

Figure 1:
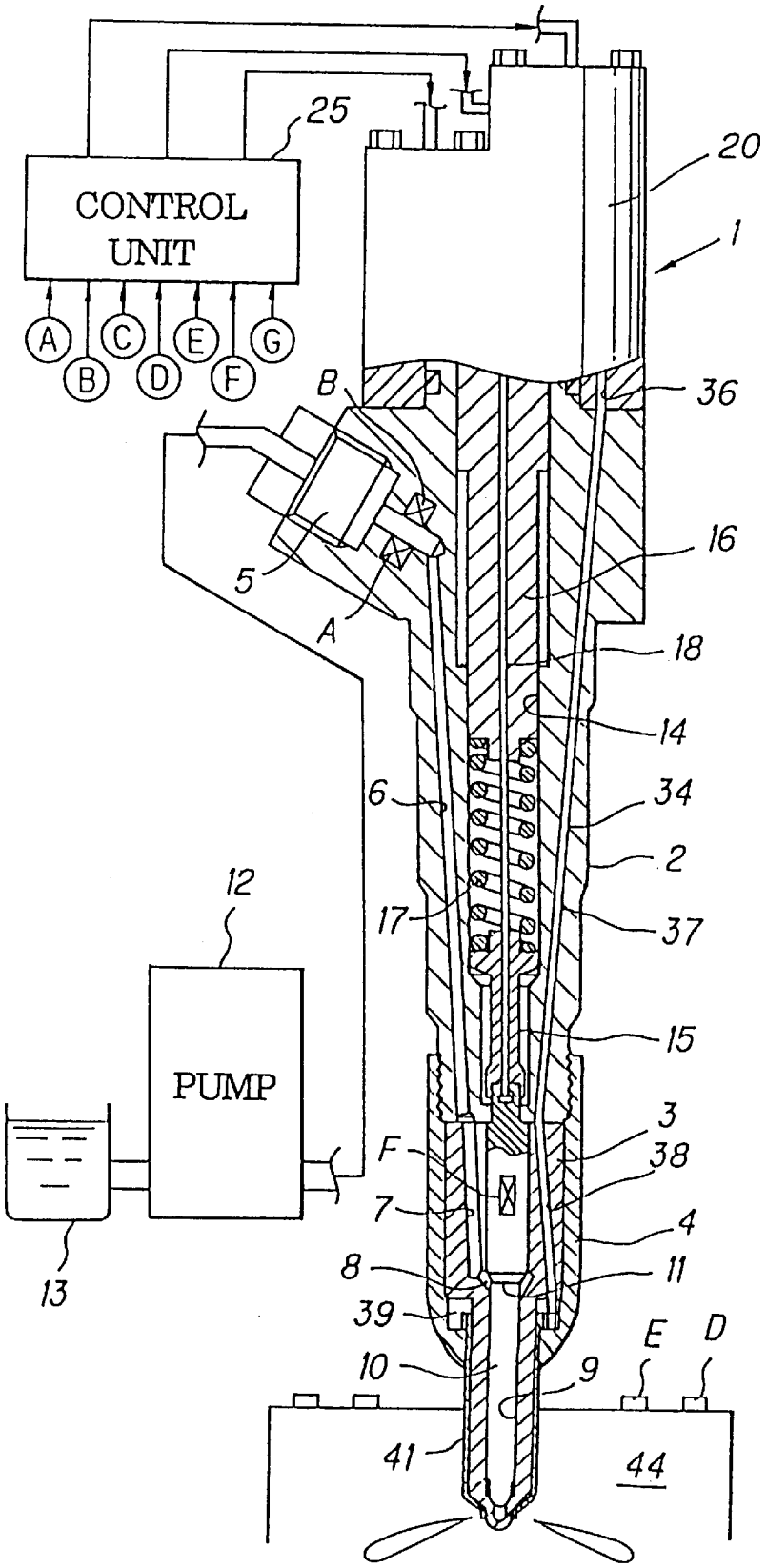
FIG. 1 is a cross section showing a schematic structure of the fuel injection nozzle according to the present invention.

In FIG. 1, which shows a first structural example of an injection nozzle 1, the injection nozzle 1 is constituted by providing a nozzle body 3 at the front end of a nozzle housing 2 and by fastening the nozzle housing 2 and the nozzle body 3 together and as an integrated part with a retaining nut 4 which is threaded onto the nozzle housing 2.

A fuel intake 5 is formed at the upper side surface of the nozzle housing 2 and this fuel intake 5 communicates with a nozzle chamber 8 formed in the middle portion of the nozzle body 3 via a passage 6 formed at the nozzle housing 2 and a passage 7 formed at the nozzle body 3. A pressure receiving portion 11 of a needle valve (needle valve) 10 inserted slidably in a fitting hole 9 of the nozzle body 3 faces the nozzle chamber 8, and high pressure fuel flowing in through the fuel intake 5 is guided to the pressure receiving portion 11 of the needle valve 10.

The high pressure fuel, which is guided to the fuel intake 5 is supplied from a fuel injection pump 12 that is connected via piping within a range of 10 MPa~150 MPa. The fuel injection pump 12, although we will not go into detail explaining it here, may be, for instance, a jerk type fuel injection pump, force feeds fuel from a fuel tank 13 to the injection nozzle 1 at a desired quantity with desired timing in correspondence to the operating environment and the like of the engine.

A through hole 14 which aligns with the fitting hole 9 of the nozzle body 3 is formed along the axis of the nozzle housing 2 and in this through hole 14, a mobile spring receptacle 15 that comes in contact with the needle valve 10, a blocking member 16 that is fitted in so as to block off the upper portion of the through hole 14 and is secured to the nozzle housing 2 and a coil-like spring 17 positioned between the mobile spring receptacle 15 and the blocking member 16 are provided. The mobile spring receptacle 15, the hollow portion of the spring 17 and a rod 18 for moving the needle valve, which passes through the blocking member 16 and is bonded to an armature 19 to be detailed later, are engaged at the needle valve 10.

Figure 2:
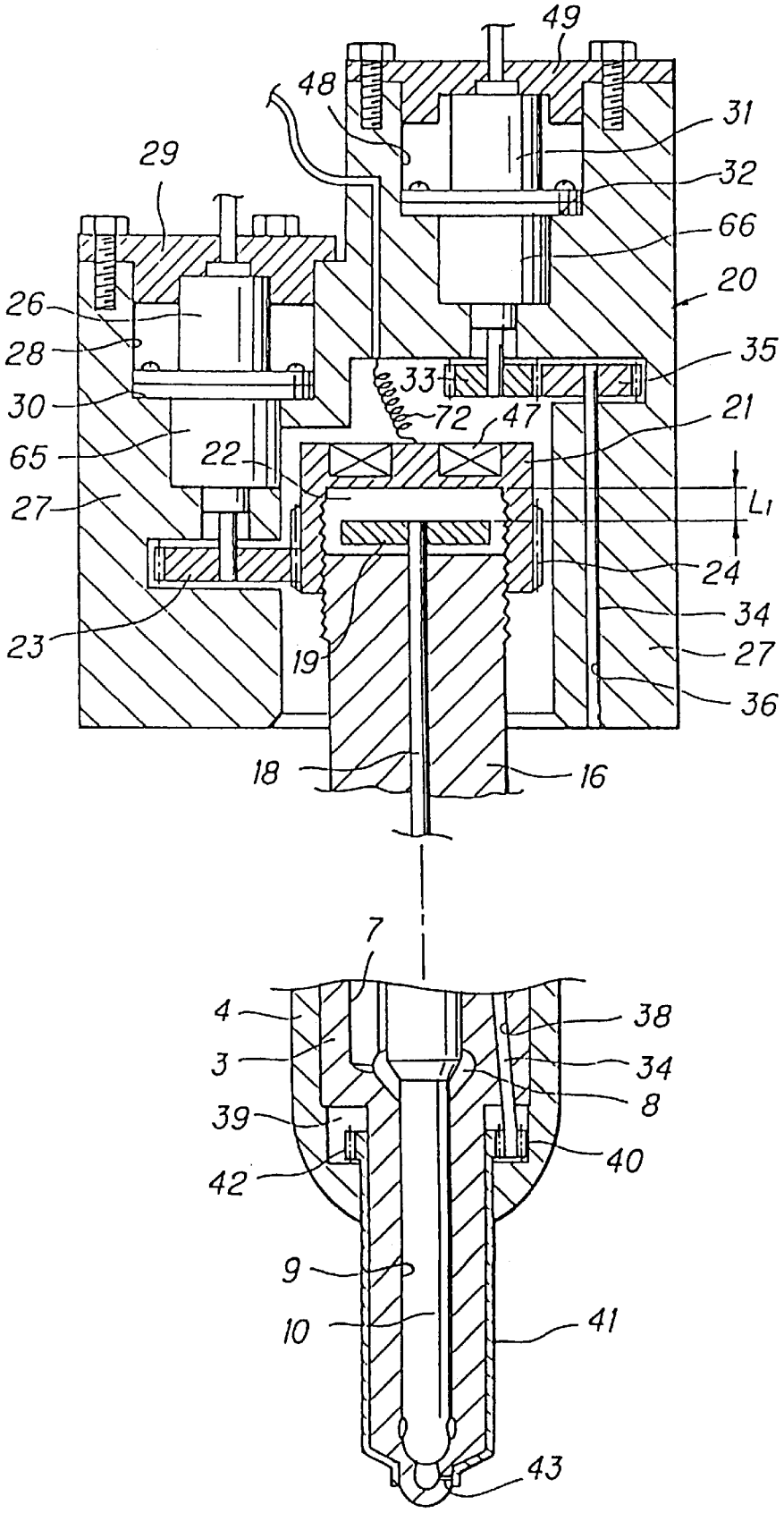
FIG. 2 is an enlarged cross section showing an example of the drive mechanism and the front end portion of the nozzle body in the fuel injection nozzle shown in FIG. 1.

At the upper portion of the nozzle housing 2, a drive mechanism 20 is provided. To be more specific, as shown in FIG. 2, a stator 21 is rotatably secured with a threaded portion at the upper end of the blocking member 16 and, as the stator 21 rotates, the stator 21 is caused to advance or retreat helically relative to the blocking member 16 so that the distance L1 between the armature 19 stored in a space 22, formed between the stator 21 and the blocking member 16, and the facing surface of the stator 21 facing opposite the armature 19, can be varied.

A solenoid 47 is wound on the stator 21 and power supply to the solenoid 47 is controlled by a control unit 25 (shown in FIG. 1). It is to be noted that reference number 72 indicates a helical wire that connects the electrical cable that is connected to the control unit 25 with the solenoid 47, and it absorbs the rotation of the stator 21.

In addition, in order to control the degree of rotation of the stator 21, a gear 23 that interlocks with teeth 24 formed on the external circumferential surface of the stator 21, is provided at a side of the stator 21, and this gear 23 is rotated as necessary by a first micromotor 26, which is driven by a control signal sent by the control unit 25 (shown in FIG. 1). It is to be noted that this first micromotor 26 is mounted at a first speed reducing gear 65 is inserted in a mounting hole 28 of a header 27 that is secured at the upper portion of the nozzle housing 2. The first micromotor 26 is fixed at a first motor mounting location 30 by a first lid body 29 that blocks off the mounting hole 28, with the gear 23 secured to the rotating shaft of the first speed reducing gear 65.

Furthermore, a mounting hole 48 for mounting a second micromotor 31 is formed at the header 27, and the second micromotor 31 is inserted in the mounting hole 48 in a state in which it is mounted at a second speed reducing gear 66, and is secured to a second motor mounting location 32 by a second lid body 49 that blocks off the mounting hole 48. A gear 33, which is provided secured to the rotating shaft of the second speed reducing gear 66, interlocks with a gear 35 which is provided secured to one end of a flexible rod 34.

In this structure, commercially available bipolar drive, two-phase stepping motors with an external diameter of $\phi$10 mm, a voltage at 5V and an output torque of 1 mN.m, for instance, are employed for the first and second micromotors 26 and 31, and commercially available speed reducing gears with, for instance, a speed reducing ratio at 1:15, an external diameter of $\phi$12 mm and a rated allowable torque of approximately 10 mN.m are employed for the first and second speed reducing gears 65 and 66 so that the torque of the micromotors is increased with the speed reducing gears.

Figure 3:
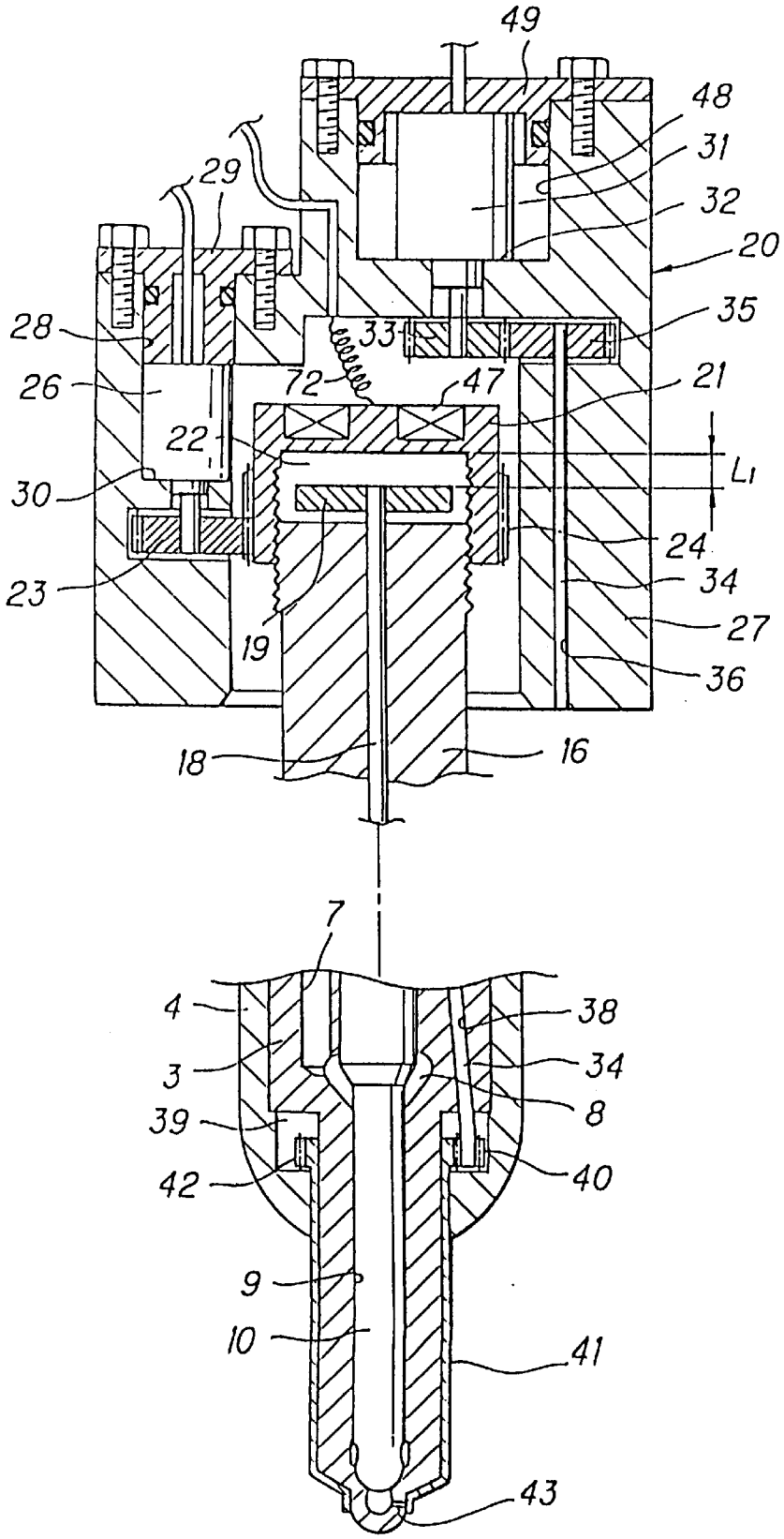
FIG. 3 is an enlarged cross section showing another example of the drive mechanism and the front end portion of the nozzle body in the fuel injection nozzle shown in FIG. 1.

As another mode of the first and second micromotors 26 and 31, the ultrasonic motor disclosed in Japanese Unexamined Patent Publication No. H6-189569 may be employed. Moreover, if micromotors with high torque are being used, the gears 23 and 33 may be directly mounted to the rotating shafts of the first and second micromotors 26 and 31, as shown in FIG. 3, with no speed reducing gears mounted. In such a structure, the space required for installing the speed reducing gears is saved, contributing to miniaturization of the injection nozzle.

The other end of the flexible rod 34 projects out into a space 39 which is formed between the nozzle body 3 and the retaining nut 4 via the header 27, the nozzle housing 2 and rod-insertion holes 36, 37 and 38 formed at the nozzle body 3, with a gear 40 which has a small diameter and is stored inside the space 39, secured to this other end of the flexible rod 34.

At the portion of the nozzle body 3 that projects out from the retaining nut 4, a cover member 41 is provided in such a manner that it is allowed to rotate only while sliding over the circumferential surface of the nozzle body. One end of the cover member 41 projects out into the space 39 through the area between the nozzle body 3 and the retaining nut 4 and on the external circumference of this projecting portion, a gear 42, which interlocks with the gear 40, is formed. As a result, when the second micromotor 31 is caused to rotate, the flexible rod 34 rotates and, ultimately, the cover member 41 is also caused to rotate.

At the front end portion of the nozzle body 3, nozzle holes 43 are formed which are opened and closed with the rotation of the cover member 41 so that, as shown in FIG. 1, fuel can be injected into a combustion chamber 44 of the engine. As shown in FIGS. 4 through 7, the nozzle holes 43, which include nozzle holes 43*a* with a large diameter, nozzle holes 43*b* with a medium diameter and nozzle holes 43*c* with a small diameter, are formed sequentially with specific shift angles, and two nozzle holes are formed with each diameter with their phases shifted by 180° from each other. The sizes of the nozzle holes will vary, depending upon the specifications of the engine for which they are intended. In this instance, the sizes of the holes are ϕ0.24 mm, ϕ0.19 mm and ϕ0.14 mm for the holes with the large diameter, the medium diameter and the small diameter respectively. In addition, the phase angle starting from the nozzle holes 43*a* with the large diameter through the nozzle holes 43*c* with the small diameter is set at less than 90°.

Along the circumference of the front end portion of the cover member 41, two each of notched portions 45 and blocking portions 46 that can cover the nozzle holes 43, are formed alternately with their phases shifted by 180° from each other. Both the blocking portions 46 and the notched portions 45 are formed larger than the phase angle from the nozzle holes 43*a* with the large diameter through the nozzle holes 43*c* with the small diameter.

Again in reference to FIG. 1, A indicates a flow rate sensor that is positioned in the vicinity of the fuel intake to detect the flow rate of the fuel supplied from the injection pump, B indicates a pressure sensor provided in the vicinity of the fuel intake to detect the pressure of the fuel supplied from the injection pump, C indicates an accelerator opening sensor which, using the engine load, detects the accelerator opening degree relative to the engine load, D indicates a combustion chamber temperature sensor that detects the temperature of the combustion chamber in the engine, E indicates a combustion chamber pressure sensor that detects the pressure in the combustion chamber in the engine, F indicates a needle valve lift sensor that detects the lift quantity of the needle valve and G indicates a rotation rate sensor that detects the rotation rate of the engine. The signals from these sensors are input to the control unit 25.

The control unit 25 is a control unit in the known art comprising an output circuit that controls the micromotors 26 and 31 and the solenoid 47, a microcomputer that controls the output circuit, an input circuit that inputs the signals from the various sensors to the microcomputer and the like. The microcomputer is provided with a central processing unit (CPU), an internal memory and the like and, based upon the signals from the sensors, performs calculation processing in conformance to a specific program to control the opening area of the nozzle holes contributing to injection, which is adjusted by the first micromotor 26; the maximum lift quantity of the needle valve 10, which is adjusted by the second micromotor 31; the timing with which fuel injection is performed with power supplied to the solenoid 47; the injection period and the like.

Figure 8:
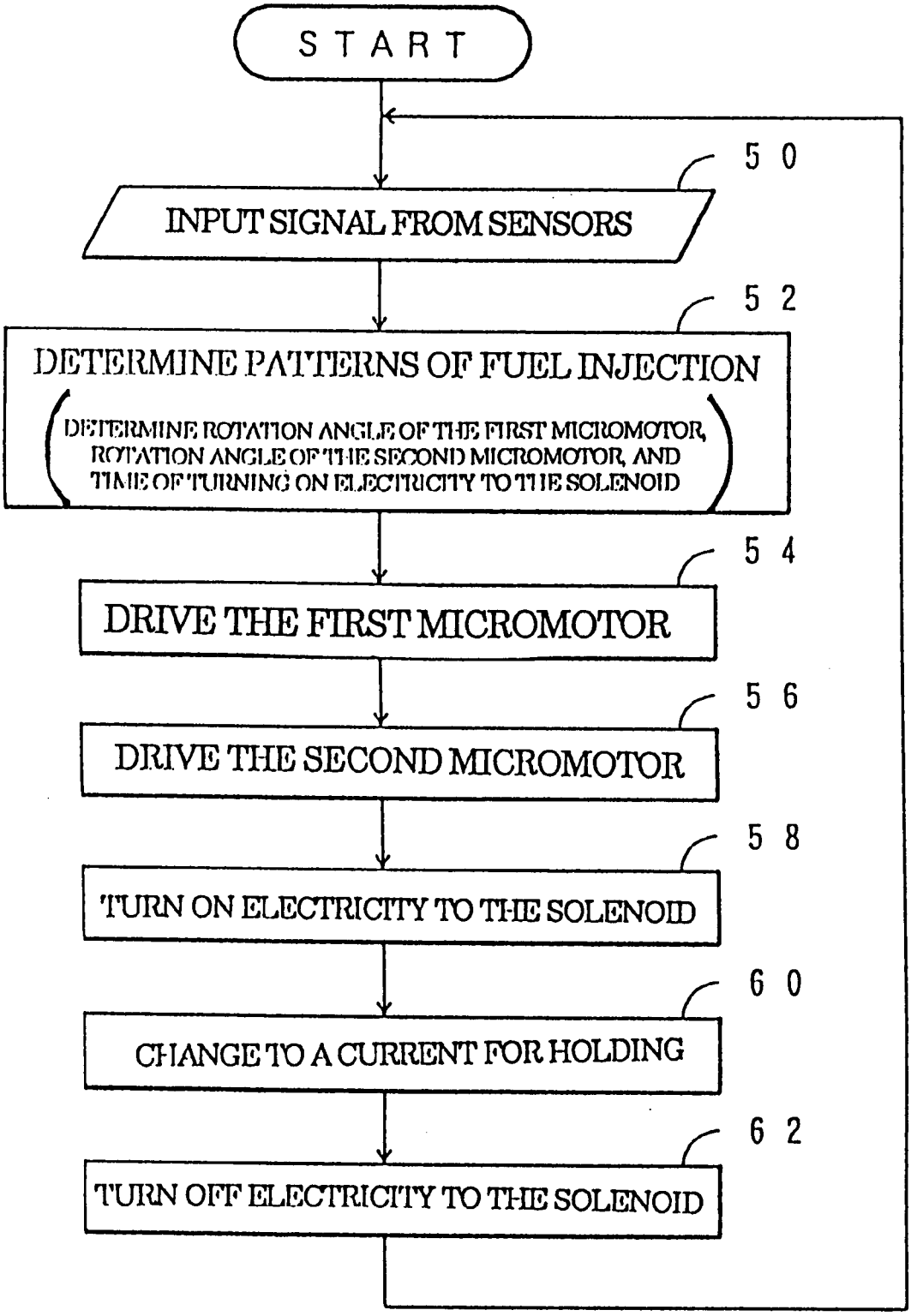
FIG. 8 is a flowchart of an example of the control operation of the injection nozzle performed by the control unit.

In other words, there is a plurality of variables for controlling the injection nozzle 1, including the rotation angle of the cover member 41, the lift quantity of the needle valve 10, the timing with which power is supplied to the solenoid 47, the duration over which power is supplied and the like, and by changing these variables, the total area of the nozzle holes contributing to injection, the injection pressure, the injection timing, the injection period and the like are adjusted to vary the injection pattern. A specific example of this control operation is presented in the form of a flowchart in FIG. 8 and the explanation below is given in reference to this flowchart. It is to be noted that a map of optimal combinations of the engine load (accelerator opening degree), the rotation rate of the engine, the combustion chamber pressure, the combustion chamber temperature, the lift quantity of the needle valve, the fuel pressure and the fuel flow rate as well as the control variables described above are stored in the internal memory of the control unit 25 and this map is created by using data that are obtained in advance through basic experiments and the like.

When the ignition switch is turned on, the control unit 25 starts the signal input processing in step 50. In step 50, measurement data from the combustion chamber pressure sensor and the like taken at a predetermined specific crank angle (an appropriate crank angle for the expansion stroke or the exhaust stroke and the engine rotation rate which has been measured by the rotation rate detection sensor G during the previous rotation of the engine are taken in.

Then, in the following step 52, a fuel injection pattern is determined based upon the input signals. In other words, the optimal values for the rotation angle of the cover member 41 and the lift quantity of the needle valve 10 are determined based upon the map stored in the internal memory of the control unit 25. Next, the rotation angle of the first micromotor 26 which will cause the needle lift to change to the determined value and the rotation angle of the second micromotor 31, which will set the total area of the nozzle holes 43 contributing to injection to the determined value are calculated based upon the needle valve lift quantity and the opening area of the nozzle holes during the previous operation. In addition, at this point, the duration of power supply to the solenoid 47 is also calculated.

After this, in step 54, a drive pulse is supplied to the first micromotor 26, so that the lift displacement quantity for the needle valve 10 which has been determined in step 52 can be achieved. Through this processing, the first micromotor 26 is caused to rotate, which, in turn, causes the stator 21 to rotate so that the distance L1 between the armature 19 and the stator 21 which faces opposite the armature 19 is adjusted. In addition, in step 56, a drive pulse is supplied to operate the second micromotor 31 so that the opening state of the nozzle holes 43 can be adjusted.

In this state, the valve opening period and the valve opening timing are determined in conformance to the map and by comparing them against the data obtained at the specific crank angle, a rectangular wave with a pulse width that corresponds to the valve opening period is generated when specific timing (crank angle) is achieved. Then, power is supplied to the solenoid 47 so that the needle valve 10 is lifted at a rise of this rectangular wave (step 58). This timing coincides with the period during which the plungers become lifted to start fuel supply in a jerk type injection pump and, consequently, with the needle valve 10 lifted, the fuel flow path is secured and fuel injection starts.

When a specific length of time has elapsed after the start of power supply to the solenoid 47, i.e., when the lift of the needle valve 10 is completed with the needle valve 10 coming in contact with the stator 21, the drive current is switched from that for startup to that for holding (step 60). This holding current is only required to be at a level which is in balance with the spring force of the spring 17 so that the contact between the armature 19 and the stator 21 can be maintained, and the current may be less than the current required for startup, when rapid acceleration is called for. Then, the position of the needle valve 10 at a point in time at which the displacement of the needle valve 10 detected by the needle valve lift sensor F has reached a constant state, is stored in the internal memory of the control unit 25.

Then, at a fall of the rectangular wave, the power supply to the solenoid 47 is stopped (step 62). With this, the needle valve 10 moves in the direction in which it is closed by the spring force applied by the spring 17 to close the nozzle holes 43.

What characterizes this series of processes in particular is that the maximum lift quantity of the needle valve 10 is adjusted by the first micromotor 26 in step 54. In other words, by causing the first micromotor 26 to rotate in the direction in which the distance between the stator 21 and the armature 19 is increased in step 54, the maximum lift quantity of the needle valve 10 increases, to increase the quantity of fuel supplied to the nozzle holes 43. In contrast, by causing the first micromotor 26 to rotate in the direction in which the stator 21 and the armature 19 approach each other, the lift quantity of the needle valve 10 is reduced, to ultimately reduce the quantity of fuel supplied to the nozzle holes 43.

During low load, low rotation rate operation at an engine startup, for instance, by increasing the lift quantity (by increasing the distance L1 between the stator 21 and the armature 19) to increase the injection pressure and, ultimately, to lengthen the period of power supply to the solenoid, fine atomization of the sprayed fuel can be promoted, whereas during high load, high rotation rate operation, by reducing the lift quantity to lower the injection pressure and, ultimately, to reduce the period of power supply to the solenoid, stable combustion can be achieved. Thus, various injection patterns can be achieved.

In addition, the operation for varying the lift quantity of the needle valve is also the operation in which the flow path resistance is changed by changing the flow path area, and in the case of a jerk type fuel injection pump, as in this embodiment, since the quantity of fuel flowing out from the pump is constant, a change in the pressure loss in the fuel flow path also constitutes a change in the injection pressure and the injection rate. In other words, when the lift quantity is small, since the flow path area is small, the pressure loss increases, to increase the peak value of the injection pressure and also to increase the change in the injection rate. In contrast, when the lift quantity is large, since the flow path area increases, the pressure loss is reduced relatively, to reduce the peak value of the injection pressure and also to reduce the change in the injection rate. If, on the other hand, an accumulator type fuel injection pump is employed, since the pressure of the fuel flowing out from the pump is constant, when the pressure loss in the fuel flow path changes due to a change in the lift quantity, the outflow flow rate can also be changed. In other words, with an accumulator type fuel injection pump, the injection quantity can be varied by changing the lift quantity. Consequently, by driving and controlling the first micromotor to vary the lift quantity, the injection quantity or the injection pressure and injection rate can be intentionally varied to achieve a desired injection pattern.

Figure 4:
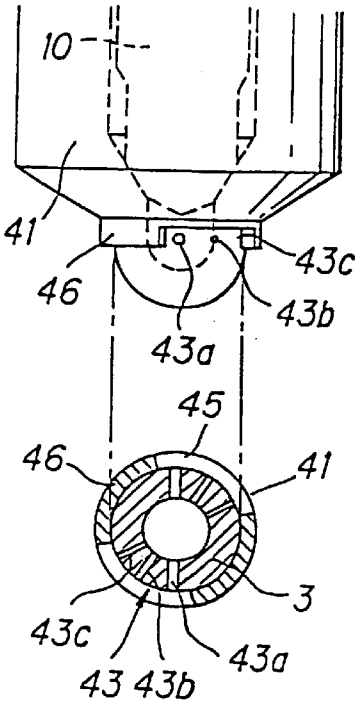

What characterizes the present invention further is that the processing performed in step 54 is implemented in combination with the control of the opening area of the nozzle holes performed by the second micromotor 31 in step 56. Namely, during the processing in step 56, by positioning the blocking portions 46 of the cover member 41 over areas where the nozzle holes 43 are not formed, as shown in FIG. 4, the nozzle holes 43*a* with the large diameter, the nozzle holes 43*b* with the medium diameter and the nozzle holes 43*c* with the small diameter all open into the combustion chamber 44 via the notched portions 45.

Figure 7:
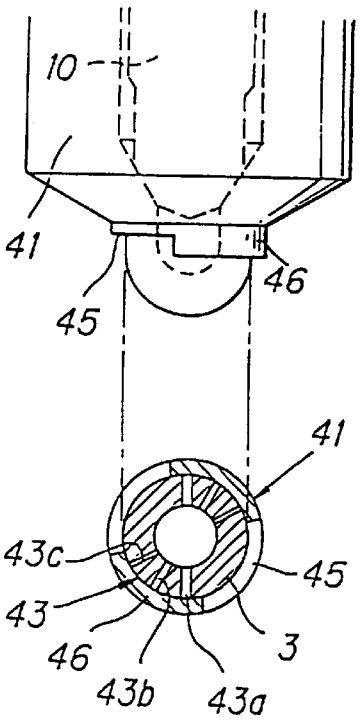
FIGS. 4~7 show a first structural sample of the front end portion of the injection nozzle, illustrating the positional relationships between the plurality of nozzle holes formed at the nozzle body and the cover member.
Figure 6:
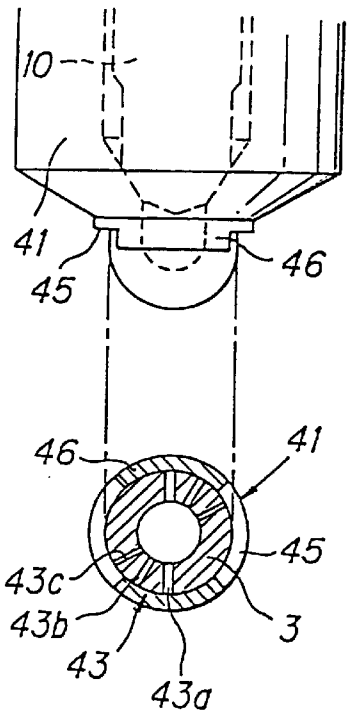
Figure 5:
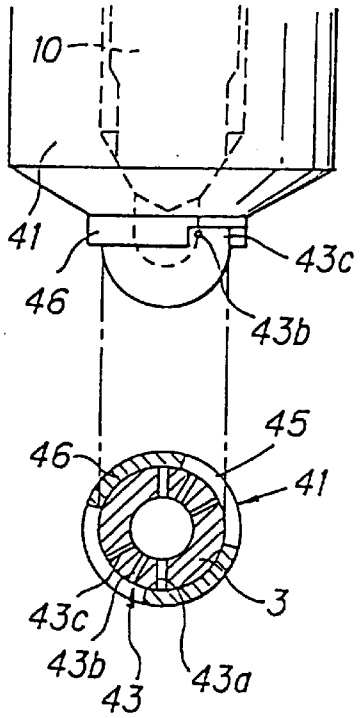

If the second micromotor 31 is rotated so that only the nozzle holes 43*a* with the large diameter are blocked off by the blocking portions 46, as shown in FIG. 5, the nozzle holes 43*b* with the medium diameter and the nozzle holes 43*c* with the small diameter still open into the combustion chamber 44, whereas, if the second micromotor 31 is rotated in such a manner that the nozzle holes 43*a* with the large diameter and the nozzle holes 43*b* with the medium diameter are blocked off by the blocking portions 46, as shown in FIG. 6, only the nozzle holes 43*c* with the small diameter open into the combustion chamber 44. By lifting the needle valve in these states, the fuel will be injected only through the nozzle holes which are open. By rotating the cover member 41 further, all the nozzle holes 43 may be blocked off, as shown in FIG. 7 so that injection is not performed even if the needle valve 10 is lifted.

For instance, if the state shown in FIG. 6 is achieved during a low load, low rotation rate operation at the time of engine startup, the injection pressure will be increased as the number of open nozzle holes and the total area of the open nozzle holes are reduced, to lengthen the injection period.

The particle size of the spray is mainly determined by the opening area of the nozzle holes 43 (43*a*, 43*b* and 43*c*) and the injection pressure, and since the fuel mist becomes finer as the opening area of the nozzle holes is reduced and the injection pressure is increased, fine atomization is promoted in the state shown in FIG. 6 so that an increase in the excess air factor in spraying can be expected to reduce NOx. In contrast, during high load, high rotation rate operation, if the state shown in FIG. 4 or FIG. 5 is achieved, the injection pressure is reduced as the number of open nozzle holes and the total area of open nozzle holes increase, to reduce the injection period. In such a state, the spray is dispersed consistently while being supplied to the combustion chamber 44, to achieve stable combustion and high output.

Figure 25:
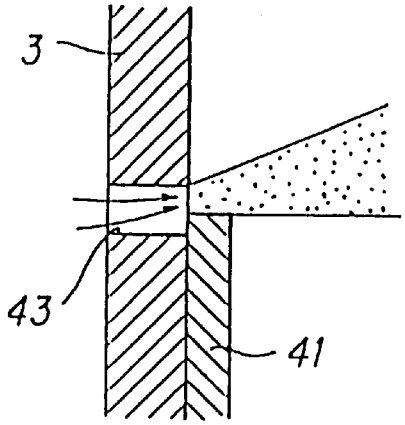
FIG. 25 is a cross section of the vicinity of the nozzle holes illustrating the present invention.
Figure 26:
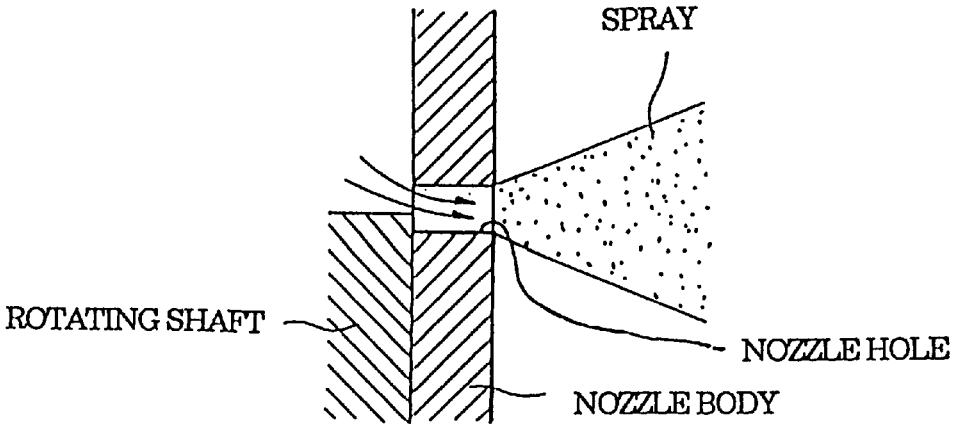
FIG. 26 is a cross section of the vicinity of the nozzle holes illustrating the prior art technology.

Consequently, changing the opening state of the nozzle holes which contribute to injection constitutes the operation for changing the injection pressure, the injection period and the degree of atomization, and by combining this with the operation performed in step 54 described earlier, the injection pattern can be varied with even greater freedom. In addition, in the structure according to the present invention, as shown in FIG. 25, since the area of the nozzle holes 43 contributing to injection is adjusted by the cover member 41 which covers the outside of the nozzle body 3, the opening area of the actual nozzle holes 43 at the front end is changed, achieving an advantage in that, compared to the structure shown in FIG. 26 in which the nozzle holes are constricted from the inside, fine atomization of the injected fuel is facilitated.

Figure 9:
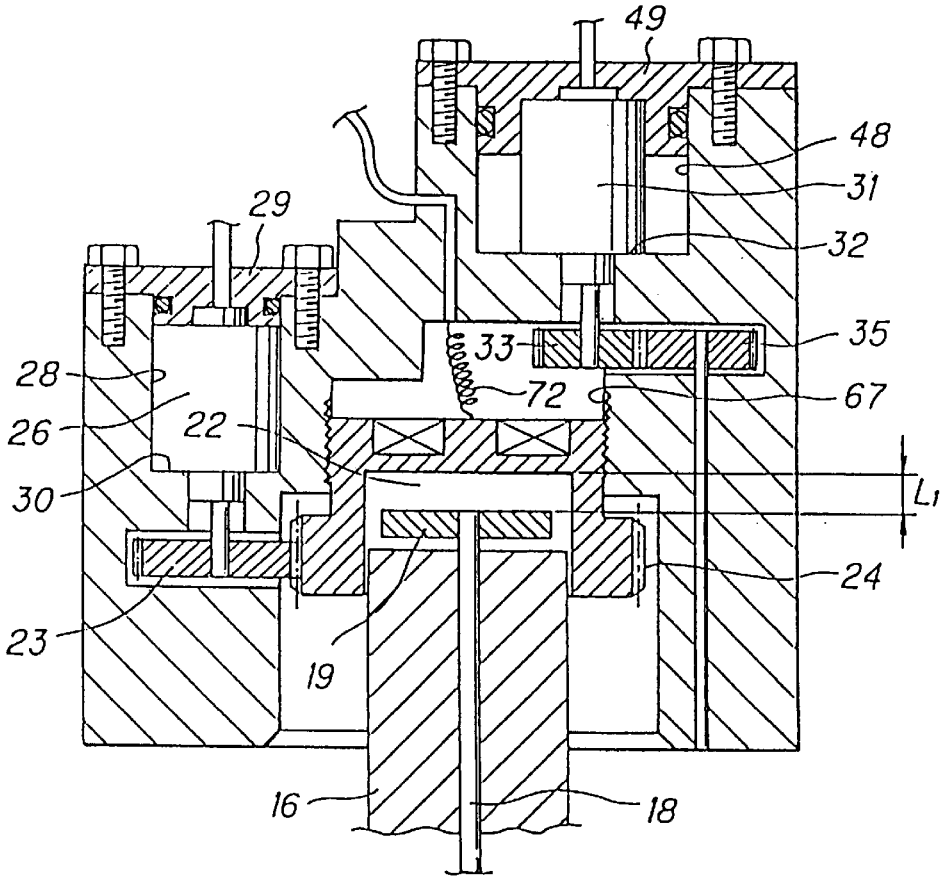
FIG. 9 is an enlarged cross section showing yet another example of the drive mechanism in the fuel injection nozzle shown in FIG. 1.

It is to be noted that as a mechanism for varying the distance L1 between the armature 19 and the stator 21, instead of the mode described above, the stator 21 may be mounted by threaded portion rotatably relative to the internal circumferential surface 67 of the header 27, with teeth formed on the external circumferential surface of the stator as in the mode described earlier, so that the gear 23 which interlocks with these teeth is caused to rotate by the first micromotor to displace the stator 21 in the direction of the axis of the needle valve, as shown in FIG. 9.

Figure 10:
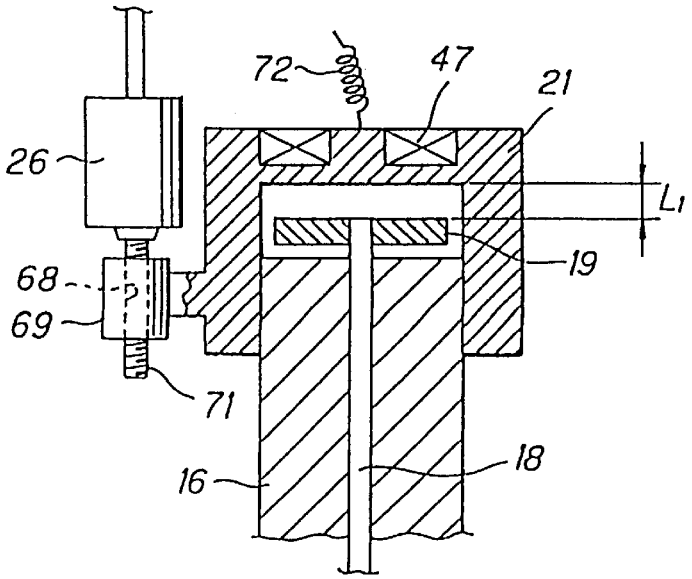
FIG. 10 is a partially enlarged cross section of another example of the lift quantity changing mechanism.

Furthermore, as shown in FIG. 10, the stator 21, which faces opposite the armature 19, may be provided covering the end portion of the blocking member 16 in such a manner that it can move in the direction of the axis of the needle valve 10, with an arm portion 69 provided with a female threaded portion 68 extending in the direction of the movement of the stator, extending at a side of the stator 21 so that a male threaded portion 71 (the threaded portion may be cut into the rotating shaft of the micromotor) which is rotated by the first micromotor 26 can be made to advance or retreat helically over the female threaded portion 68 of the arm portion 69 to displace the stator 21 in the direction of the axis of the needle valve.

Figure 11:
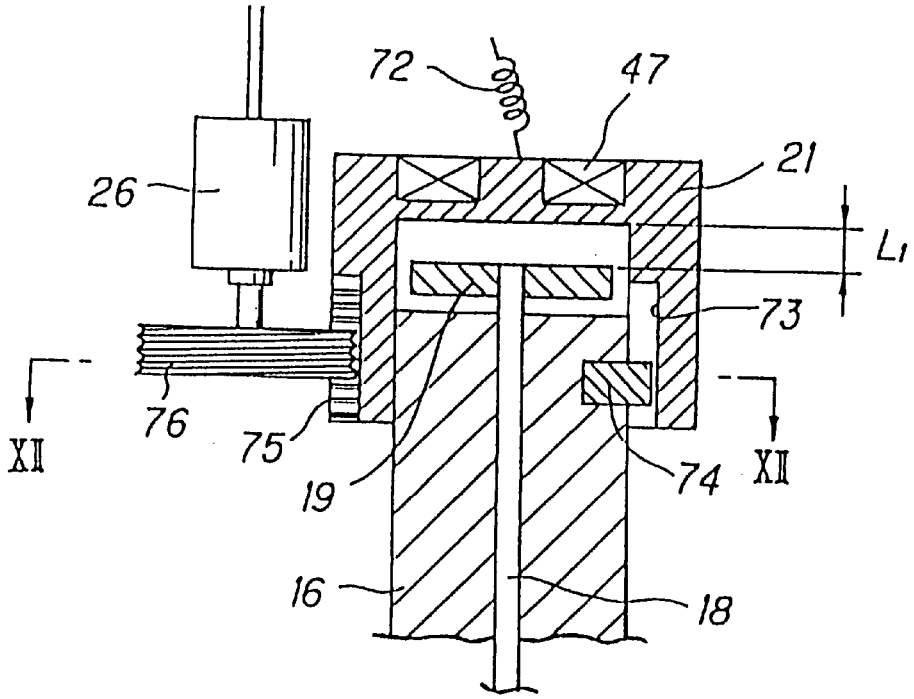
FIG. 11 is a partial enlarged cross section of yet another example of the lift quantity changing mechanism.
Figure 12:
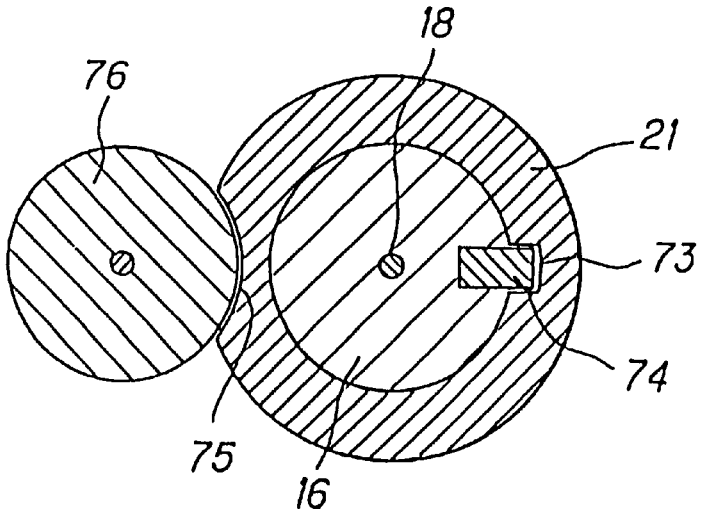
FIG. 12 is a cross section through line XII—XII in FIG. 11.
Figure 16:
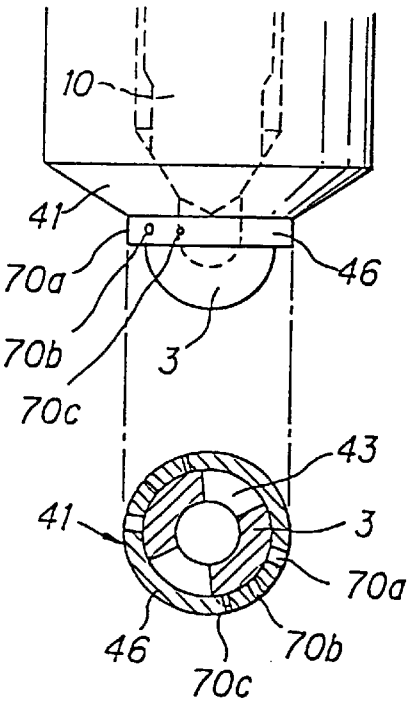
FIGS. 13~16 show a second structural example of the front end portion of the injection nozzle, illustrating the communicating relationship between the nozzle holes formed at the nozzle body and the plurality of nozzle holes formed at the cover member.

In yet another mode, as shown in FIGS. 11 and 12, the stator 21 is provided covering the end portion of the blocking member 16 in a similar manner, and a key groove 73 extending in the direction of the axis of the blocking member 16 is formed on the internal surface of the stator 21 so that a fixed pin 74, which is secured at the blocking member 16, is connected in the key groove 73 to inhibit the rotation of the stator 21 and so that the stator 21 is allowed to move only in the direction of the axis of the needle valve. In addition, a rack portion 75, which is achieved by notching a portion of the external side surface of the stator 21 in an arc shape is formed and teeth are formed at this rack portion 75 along the direction of the axis of the stator 21. A cylindrical worm 76 which interlocks with the teeth of the rack portion 75 is mounted securely to the rotating shaft of the first micromotor 26 so that by rotating the first micromotor 26, the stator 21 can be displaced in the direction of the axis of the needle valve.

In FIGS. 13 through 16, a second structural example that is employed to achieve adjustment of the opening state of the nozzle holes 43 is shown. In this embodiment, unlike the previous embodiment, blocking portions 46 of a cover member 41 is provided over the entire circumference with nozzle holes 70*a* with a large diameter, nozzle holes 70*b* with a medium diameter and nozzle holes 70*c* with a small diameter sequentially formed with specific shift angles at the blocking portions 46. Two nozzle holes of each diameter are formed with their phases shifted by 180° from each other. In this embodiment, too, the phase angle ranging from the nozzle holes 70*a* with the large diameter to the nozzle holes 70*c* with the small diameter is set smaller than 90°.

At the front end portion of the nozzle body 3, on the other hand, two wide angle nozzle holes 43 are formed with their phases shifted by 180° from each other, with the angle of the circumference of the nozzle holes 43 and the angle of the circumference of the area where no nozzle holes are formed both larger than the phase angle from the nozzle holes 43*a* with the large diameter to the nozzle holes 43*c* with the small diameter formed at the cover member 41.

It is to be noted that other structural features of this embodiment are identical to those in the first embodiment and their explanation is omitted, with the same reference numbers assigned to components in FIGS. 13 through 16 that are identical to those shown in FIGS. 4 through 7.

Figure 15:
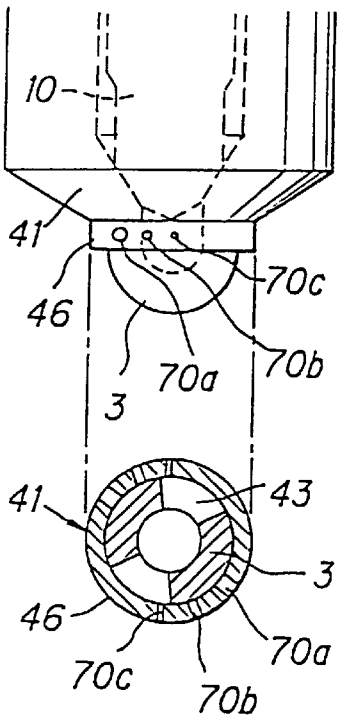
Figure 14:
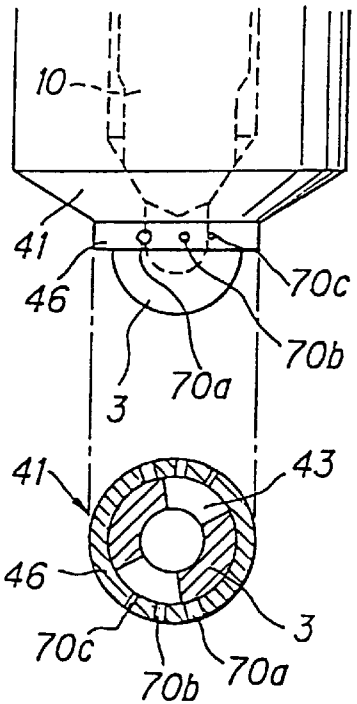
Figure 13:
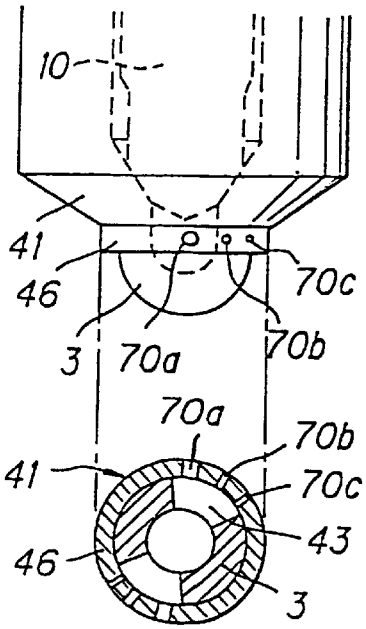

In this structure, too, the injection pattern can be varied by employing the second micromotor 31 to adjust the communicating state between the nozzle holes 43 at the nozzle body 3 and the nozzle holes 70*a*, 70*b* and 70*c* at the cover member 41. In other words, as shown in FIG. 13, by making the nozzle holes 43 at the nozzle body 3 communicate with all the nozzle holes 70*a*, 70*b* and 70*c* formed at the blocking portions 46 of the cover member 41, fuel is injected into the combustion chamber 44 through all the nozzle holes, i.e., the nozzle holes 70*a* with the large diameter, the nozzle holes 70*b* with the medium diameter and the nozzle holes 70*c* with the small diameter, whereas, by rotating the cover member 41 to cut off the communication between the nozzle holes 43*a* with the large diameter and the nozzle holes 43 at the nozzle body 3, as shown in FIG. 14, fuel is injected into the combustion chamber through the nozzle holes 43*b* with the medium diameter and the nozzle holes 43*c* with the small diameter. By rotating the cover member 41 in such a manner that the nozzle holes 43*a* with the large diameter and the nozzle holes 43*b* with the medium diameters are cut off from the nozzle holes 43 at the nozzle body 3, the fuel is injected into the combustion chamber 44 only through the nozzle holes 43*c* with the small diameter, as shown in FIG. 15. When the cover member 41 is rotated further, all of the nozzle holes at the cover member 41 may be cut off from the nozzle holes 43 at the nozzle body 3 so that, even if the needle valve 10 is lifted, fuel is not injected. Consequently, by controlling the second micromotor 31, the injection pressure, the injection period and the degree of atomization can be varied as in the case of the first embodiment, achieving various injection patterns.

In FIGS. 17 through 20, a third structural example that is employed to achieve the adjustment of the opening state of the nozzle holes 43 is presented, and in this embodiment, a nozzle hole 43 which is formed in a slit shape with a specific angle of circumference is provided at two locations whose phases are shifted from each other by 180°. The angle of circumference of these nozzle holes 43 is set at less than 90°. It is to be noted that the slit width of the nozzle holes 43 formed in this slit shape is set approximately equal to the diameter of the nozzle holes with the large diameter mentioned earlier (maximum 0.24 mm) and that if nozzle holes 43 are to be formed at four locations at the front end of the nozzle body 3, their angle of circumference is only required to be set at less than 45°.

At the front end portion of the cover member 41, on the other hand, notched portions 45 and blocking portions 46 which are capable of covering the nozzle holes 43 are formed alternately at two locations each with their phases shifted by 180° on the circumference of the front end, as in the case of the first embodiment (FIGS. 4~7). The blocking portions 46 and the notched portions 45 are both formed larger than the angle of circumference of the nozzle holes 43 that are formed in the slit shape.

Figure 20:
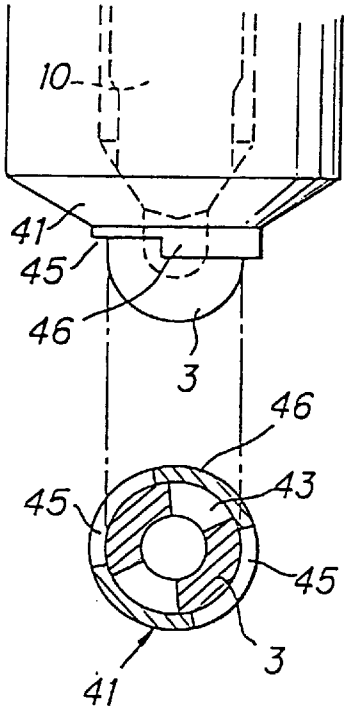
FIGS. 17~20 show a third structural example of the front end portion of the injection nozzle, illustrating the positional relationship between the slit-shaped nozzle holes formed at the nozzle body and the cover member.
Figure 19:
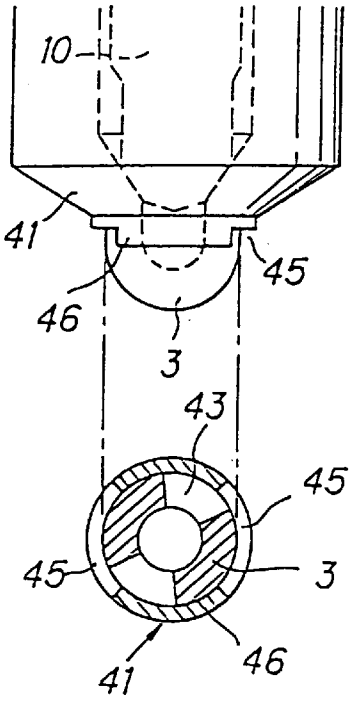
Figure 18:
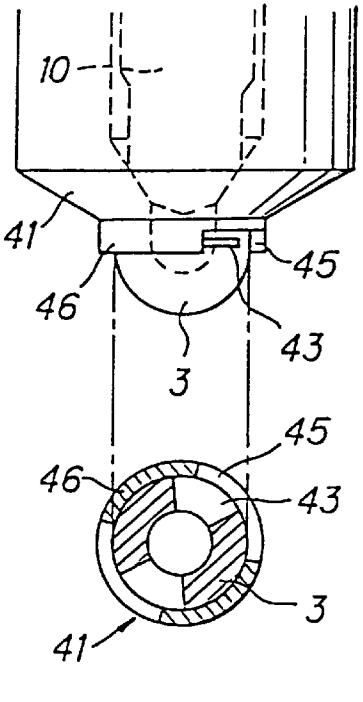
Figure 17:
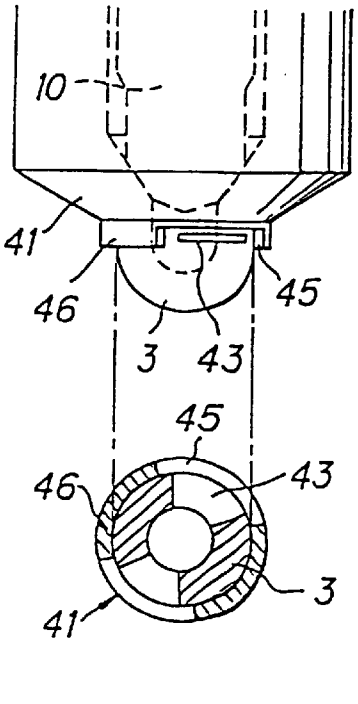
Figure 24:
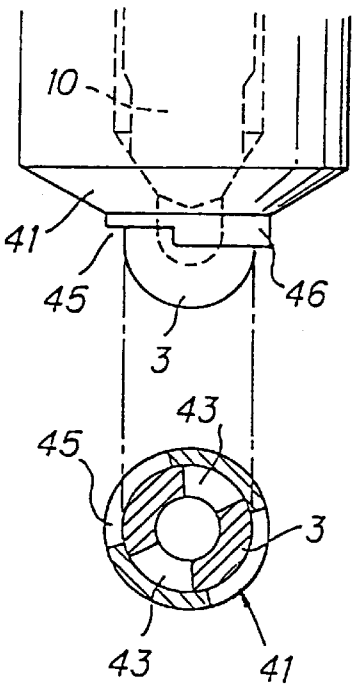
FIGS. 21~24 show a fourth structural example of the front end portion of the injection nozzle, illustrating the positional relationship between the slit-shaped nozzle holes at the nozzle body and the cover member.
Figure 23:
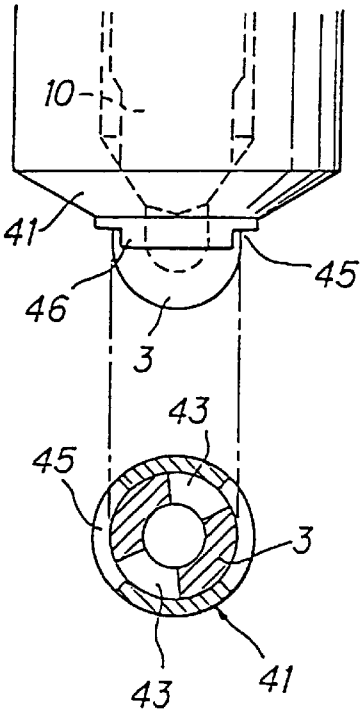
Figure 22:
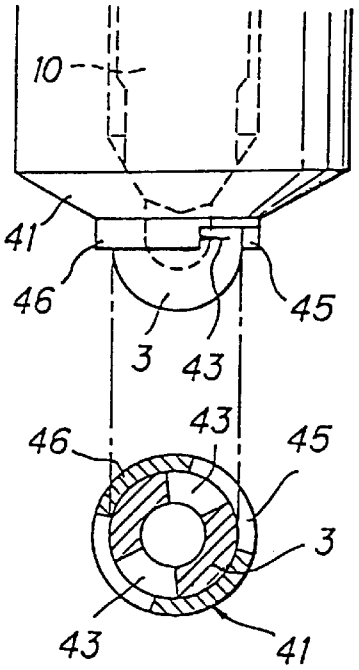
Figure 21:
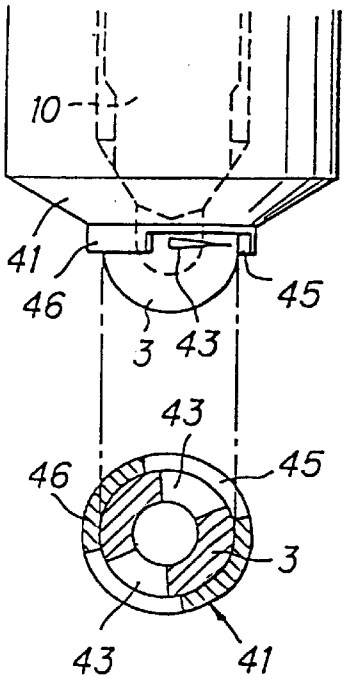

The structure in which the nozzle holes 43 are provided in the manner described above corresponds to a structure in which nozzle holes with the same diameter are continuously formed over a specific range, and, consequently, by changing the relative positions between the nozzle holes 43 at the nozzle body 3 and the blocking portions 46 at the cover member 41, the injection pattern can be changed. In other words, by making the nozzle holes 43 at the nozzle body 3 face the combustion chamber 44 without having them blocked by the blocking portions 46 of the cover member 41 at all, as shown in FIG. 17, a great quantity of fuel can be injected into the combustion chamber 44 over a wide angle, whereas, by rotating the cover member 41 to block off some of the nozzle holes 43 at the nozzle body 3 with the blocking portions 46 as shown in FIG. 18 or 19, the injection range is narrowed. Moreover, by further rotating the cover member 41, all of the nozzle holes 43 at the nozzle body 3 become blocked off with the blocking portions as shown in FIG. 20, and no fuel is injected even when the needle valve 10 is lifted. As a result, by controlling the second micromotor 31, the dispersion of the injected spray and the nozzle hole opening area can be varied so that, as in the first embodiment described earlier, the injection pressure, the injection period and the degree of atomization can be changed, achieving various injection patterns.

Yet another structural example for achieving adjustment of the opening state of the nozzle holes 43, i.e., a fourth structural example, is shown in FIGS. 21 through 24. In this embodiment, which is similar to the third structural example in that the slit-like nozzle holes are formed at two locations with their phases shifted by 180° from each other, the nozzle holes 43 are formed in a wedge shape such that they are gradually reduced in the direction in which the nozzle hole opening area is narrowed by the cover member 41. Since other aspects of this embodiment are identical to those in the third embodiment, the same reference numbers are assigned to components identical to those shown in FIGS. 17 through 20 and their explanation is omitted. In this structure, too, similar advantages to those achieved in the third embodiment are achieved.

As has been explained, according to the present invention, since the maximum lift quantity of the needle valve which opens and closes the nozzle holes is adjusted by the lift quantity changing mechanism, it is possible to promote fine atomization of the spray and to maintain stable combustion. In addition, by changing the injection pattern intentionally, i.e., by changing the injection quantity in the case of an accumulator type injection nozzle and by changing the injection pressure and the injection rate in the case of a jerk type injection nozzle, it is adaptable to a variety of environments.

In addition, since the total area of the nozzle holes contributing to injection can be adjusted by rotating the cover member, it becomes possible to achieve an injection pressure, injection period and injection quantity that correspond to a given load and rotation rate of the engine, thereby achieving a reduction in NOx and an improvement in fuel efficiency. Furthermore, since the total area of the nozzle holes contributing to injection can be varied from the outside by employing the cover member, a member for changing the nozzle hole area is not required inside the nozzle body, thereby succeeding in reducing the suck volume formed immediately in front of the nozzle holes. In such a structure, the alignment of the axis of the cover member that changes the effective area of the nozzle holes and the valve inside the nozzle body is not required. Moreover, since the opening areas at the front ends of the nozzle holes are changed, fine atomization of the injected fuel is facilitated.

Furthermore, by performing adjustment of the lift quantity of the needle valve in combination with the adjustment of the total area of the nozzle holes contributing to injection, the injection pattern can be varied to conform to various environmental conditions with an even greater degree of freedom.

We claim:

1. A fuel injection nozzle comprising:

a nozzle body with nozzle a hole formed at a front end portion thereof through which pressurized fuel is injected;

a needle valve inserted slidably in said nozzle body to open and close said nozzle hole;

a spring that applies a force to said needle valve in a direction in which said nozzle holes are closed;

an armature provided on an extended line of an axis of said needle valve that becomes displaced along with said needle valve;

a stator provided facing opposite said armature on an extended line of said axis of said needle valve that electromagnetically attracts said armature against said force applied by said spring when power is supplied to said stator;

a first micromotor that is driven and controlled by an external signal, a lift quantity changing mechanism that enables displacement of said stator on an extended line of said axis of said needle valve by employing said first micromotor in order to ensure that a maximum lift quantity of said needle valve can be varied;

a cover member that rotates slidably around a circumference of said nozzle body with blocking portions for varying blockage of said nozzle holes in correspondence to a degree of rotation thereof formed as an integrated part; and a second micromotor that is driven and controlled by an external signal wherein:

said rotation of said cover member is enabled by said second micromotor to vary opening area of said nozzle holes contributing to injection.

2. A fuel injection nozzle, according to claim 1, wherein:

said nozzle quantity changing mechanism is achieved by securing said stator in such a manner that said stator can advance or retreat helically in a direction of said axis of said needle valve relative to an immobile member provided near said armature, forming teeth on an external circumferential surface of said stator and causing a gear that interlocks with said teeth to rotate by said first micromotor to cause said stator to be displaced in said direction of said axis of said needle valve.

3. A fuel injection nozzle according to claim 1, wherein:

said lift quantity changing mechanism is achieved by providing said stator slidably in a direction of said axis of said needle valve relative to an immobile member provided near said armature, forming a rack portion provided with teeth extending in a direction of an axis of said stator at a portion of an external circumferential surface of said stator and causing a cylindrical worm that interlocks with said rack portion to rotate by said first micromotor to cause said stator to be displaced in said direction of said axis of said needle valve.

4. A fuel injection nozzle according to claim 1, wherein:

said lift quantity changing mechanism is achieved by providing said stator slidably in a direction of said axis of said axis needle valve relative to an immobile member near said armature, providing an arm with a female threaded portion extending in a direction of an axis of said stator at a side of said stator and causing a male threaded portion that is rotated by said first micromotor to advance or retreat helically over said female threaded portion at said arm portion to cause said stator to be displaced in said direction of said axis of said needle valve.

5. A fuel injection nozzle according to claim 1, wherein:

said nozzle body, with said nozzle hole formed at a front end portion thereof through which pressurized fuel is injected, is fastened to a front end of a nozzle housing by a retaining nut;

said needle valve inserted slidably in said nozzle body to open and close said nozzle hole is linked to said armature via a rod that passes through a through hole formed at said nozzle housing; and said spring that applies a force to said needle valve in a direction in which said nozzle hole is closed is provided in said through hole in such a manner that said rod passes through said spring and said spring is also positioned between a mobile spring receptacle that comes in contact with said needle valve and a blocking member secured to said nozzle housing to block off said through hole.

6. A fuel injection nozzle according to claim 1, wherein:

a plurality of nozzle holes are formed at specific intervals in a circumferential direction of said nozzle body and by varying the number of said nozzle holes that are blocked off by said blocking portions with rotation of said cover member, an opening area of said nozzle holes contributing to injection is varied.

7. An injection nozzle according to claim 6, wherein:

diameters of said plurality of nozzle holes formed at specific intervals in said circumferential direction of said nozzle body are gradually reduced in an order in which said nozzle holes are blocked off by said blocking portions.

8. A fuel injection nozzle according to claim 1, wherein:

a plurality of nozzle holes that can communicate with said nozzle holes at said nozzle body are formed in a circumferential direction of said blocking portions of said cover member at specific intervals, and by varying the number of said nozzle holes at said blocking portions that communicate with said nozzle holes at said nozzle body with rotation of said cover member, an opening area of said nozzle holes contributing to injection is varied.

9. An injection nozzle according to claim 8, wherein:

diameters of said plurality of injection holes formed in said circumferential direction of said blocking portions at specific intervals are gradually reduced in an order in which communication thereof with said nozzle holes at said nozzle body is cut off.

10. A fuel injection nozzle according to claim 1, wherein:

a nozzle hole formed in a slit shape with a specific angle of circumferential is provided at said nozzle body and by varying blockage of said nozzle hole by said blocking portions through rotation of said cover member, an opening area of said nozzle hole contributing to injection is varied.

11. An injection nozzle according to claim 10, wherein:

said nozzle hole shaped in a slit shape provided at said nozzle body has a wedge shape such that said shape is gradually narrowed in a direction in which a nozzle hole area is reduced by said blocking portions.

12. A fuel injection nozzle according to claim 1, further provided with:

a flexible rod ranging from the vicinity of said second micromotor to the vicinity of said cover member with gears provided at two ends thereof; wherein:

one of said gears provided at one end of said flexible rod interlocks with a gear that is rotated by said second micromotor, another of said gears, i.e., a gear provided at another and of said flexible rod, interlocks with a gear provided on an external circumferential surface of said cover member and a motive force is communicated from said second micromotor to said cover member via said flexible rod.

13. A fuel injection nozzle comprising:

a nozzle body with a nozzle hole formed at a front end portion thereof through which pressurized fuel is injected;

a needle valve inserted slidably in said nozzle body to open and close said nozzle hole;

a spring that applies a force to said needle valve in a direction in which said nozzle holes are closed;

an armature provided on an extended line of an axis of said needle valve that becomes displaced along with said needle valve;

a stator provided facing opposite said armature on an extended line of said axis of said needle valve that electromagnetically attracts said armature against said force applied by said spring when power is supplied to said stator;

a micromotor that is driven and controlled by an external signal, a lift quantity changing mechanism that enables displacement of said stator on an extended line of said axis of said needle valve by employing said micromotor in order to ensure that a maximum lift quantity of said needle valve can be varied;

said lift quantity changing mechanism is achieved by securing said stator in such a manner that said stator can advance or retreat helically in a direction of said axis of said needle valve relative to an immobile member provided near said armature, forming teeth on an external circumferential surface of said stator and causing a gear that interlocks with said teeth to rotate by said micromotor to cause said stator to be displaced in said direction of said axis of said needle valve;

a cover member that rotates slidably around a circumference of said nozzle body with blocking portions for varying blockage of said nozzle holes in correspondence to a degree of rotation thereof formed as an integrated part; and a second micromotor that is driven and controlled by an external signal wherein:

said rotation of said cover member is enabled by said second micromotor to vary opening area of said nozzle holes contributing to injection.

14. A fuel injection nozzle comprising:

a nozzle body with a nozzle hole formed at a front end portion thereof through which pressured fuel is injected;

a needle valve inserted slidably in said nozzle body to open and close said nozzle hole;

a spring that applies a force to said needle valve in a direction in which said nozzle holes are closed;

an armature provided on an extended line of an axis of said needle valve that becomes displaced along with said needle valve;

a stator provided facing opposite said armature on an extended line of said axis of said needle valve that electromagnetically attracts said armature against said force applied by said spring when power is supplied to said stator;

a micromotor that is driven and controlled by an external signal, a lift quantity changing mechanism that enables displacement of said stator on an extended line of said axis of said needle valve by employing said micromotor in order to ensure that a maximum lift quantity of said needle valve can be varied;

said lift quantity changing mechanism is achieved by securing said stator in such a manner that said stator can advance or retreat helically in a direction of said axis of said needle valve relative to an immobile member provided near said armature, forming teeth on an external circumferential surface of said stator and causing a gear that interlocks with said teeth to rotate by said micromotor to cause said stator to be displaced in said direction of said axis of said needle valve;

a cover member that rotates slidably around a circumference of said nozzle body with blocking portions for varying blockage of said nozzle holes in correspondence to a degree of rotation thereof formed as an integrated part; and a second micromotor that is driven and controlled by an external signal wherein:

said lift quantity changing mechanism is achieved by providing said stator slidably in a direction of said axis of said needle valve relative to an immobile member provided near said armature, forming a rack portion provided with teeth extending in a direction of an axis of said stator at a position of an external circumferential surface of said stator and causing a cylindrical worm that interlocks with said rack portion to rotate by said micromotor to cause said stator to be displaced in said direction of said axis of said needle valve.

15. A fuel injection nozzle comprising:

a nozzle body with a nozzle hole formed at a front end portion thereof through which pressurized fuel is injected;

a needle valve inserted slidably in said nozzle body to open and close said nozzle hole;

a spring that applies a force to said needle valve in a direction which said nozzle holes are closed;

an armature provided on an extended line of an axis of said needle valve that becomes displaced along with said needle valve;

a stator provided facing opposite said armature on an extended line of said axis of said needle valve that electromagnetically attracts said armature against said force applied by said spring when power is supplied to said stator;

a micrometer that is driven and controlled by an external signal, a lift quantity changing mechanism that enables displacement of said stator on an extended line of said axis of said needle valve by employing said micromotor in order to ensure that a maximum lift quantity of said needle valve can be varied;

said lift quantity changing mechanism is achieved by securing said stator in such a manner that said stator can advance or retreat helically in a direction of said axis of said needle valve relative to an immobile member provided near said armature, forming teeth on an external circumferential surface of said stator and causing a gear that interlocks with said teeth to rotate by said micromotor to cause said stator to be displaced in said direction of said axis of said needle valve;

a cover member that rotates slidably around a circumference of said nozzle body with blocking portions for varying blockage of said nozzle holes in correspondence to a degree of rotation thereof formed as an integrated part; and a second micromotor that is driven and controlled by an external signal wherein:

said lift quantity changing mechanism is achieved by providing said stator slidably in a direction of said axis of said needle valve relative to an immobile member near said armature, providing an arm portion with a female threaded portion extending in a direction of an axis of said stator at a side of said stator and causing a male threaded portion that is rotated by said micromotor to advance or retreat helically over said female threaded portion at said arm portion to cause said stator to be displaced in said direction of said axis of said needle valve.

16. A fuel injection nozzle comprising:

a nozzle body with a nozzle hole formed at a front end portion thereof through which pressurized fuel is injected;

a needle valve inserted slidably in said nozzle body to open and close said nozzle hole;

a spring that applies a force to said needle valve in a direction in which said nozzle holes are closed;

an armature provided on an extended line of an axis of said needle valve that becomes displaced along with said needle valve;

a stator provided facing opposite said armature on an extended line of said axis of said needle valve that electromagnetically attracts said armature against said force applied by said spring when power is supplied to said stator;

a micromotor that is driven and controlled by an external signal, a lift quantity changing mechanism that enables displacement of said stator on an extended line of said axis of said needle valve by employing said micromotor in order to ensure that a maximum lift quantity of said needle valve can be varied;

said lift quantity changing mechanism is achieved by securing said stator in such a manner that said stator can advance or retreat helically in a direction of said axis of said needle valve relative to an immobile member provided near said armature, forming teeth on an external circumferential surface of said stator and causing a gear that interlocks with said teeth to rotate by said micromotor to cause said stator to be displaced in said direction of said axis of said needle valve;

a cover member that rotates slidably around a circumference of said nozzle body with blocking portions for varying blockage of said nozzle holes in correspondence to a degree of rotation thereof formed as an integrated part; and a second micromotor that is driven and controlled by an external signal wherein:

said nozzle body, with said nozzle hole formed at a front end portion thereof through which pressurized fuel is injected, is fastened to a front end of a nozzle housing by a retaining nut;

said needle valve inserted slidably in said nozzle body to open and close said nozzle hole is linked to said armature via a rod that passes through a through hole formed at said nozzle housing; and said spring that applies a force to said needle valve in a direction in which said nozzle hole is closed is provided in said through hole in such a manner that said rod passes through said spring and said spring is also positioned between a mobile spring receptacle that comes in contact with said needle valve and a blocking member secured to said nozzle housing to block off said through hole.

17. A fuel injection nozzle comprising:

a nozzle body with a nozzle hole through which pressurized fuel is injected formed at a front end portion thereof;

a needle valve inserted slidably in said nozzle body to open and close said nozzle hole, a cover member that rotates slidably around a circumference of said nozzle body with blocking portions for varying blockage of said nozzle holes in correspondence to a degree of rotation thereof formed as an integrated part; and a micromotor that is driven and controlled by an external signal to rotate said cover member, wherein:

a nozzle hole formed in a slit shape with a specific angle of circumference is provided at said nozzle body and by varying blockage of said nozzle hole by said blocking portions through rotation of said cover member, an opening area of said nozzle hole contributing to injection is varied.

18. An injection nozzle according to claim 17, wherein:

said nozzle hole shaped in a slit shape provided at said nozzle body has a wedge shape such that said shape is gradually narrowed in a direction in which a nozzle hole area is reduced by said blocking portions.

19. A fuel injection nozzle comprising:

a nozzle body with a nozzle hole through which pressurized fuel is injected formed at a front end portion thereof;

a needle valve inserted slidably in said nozzle body to open and close said nozzle hole, a cover member that rotates slidably around a circumference of said nozzle body with blocking portions for varying blockage of said nozzle holes in correspondence to a degree of rotation thereof formed as an integrated part; and a micromotor that is driven and controlled by an external signal to rotate said cover member, wherein:

a flexible rod ranging from the vicinity of said micromotor to the vicinity of said cover member with gears provided at two ends thereof;

one of said gears provided at one end of said flexible rod interlocks with a gear that is rotated by said micromotor, another of said gears, i.e., a gear provided at another and of said flexible rod, interlocks with a gear provided on an external circumferential surface of said cover member and a motive force is communicated from said micromotor to said cover member via said flexible rod.

* * * * *